US008348099B2

(12) United States Patent
Chen et al.

(10) Patent No.: US 8,348,099 B2
(45) Date of Patent: Jan. 8, 2013

(54) POWDER ALLOTTING DEVICE

(75) Inventors: Yan-Ting Chen, Tao-Yuan (TW); Shi-Hsi Liu, Tao-Yuan (TW); Chien-Da Ho, Tao-Yuan (TW); I-Feng Lo, Tao-Yuan (TW); Shih-Ming Wang, Tao-Yuan (TW)

(73) Assignee: Chung Yuan Christian University, Tao-Yuan (TW)

( * ) Notice: Subject to any disclaimer, the term of this patent is extended or adjusted under 35 U.S.C. 154(b) by 0 days.

(21) Appl. No.: 12/748,942

(22) Filed: Mar. 29, 2010

(65) Prior Publication Data

US 2011/0226811 A1 Sep. 22, 2011

(30) Foreign Application Priority Data

Mar. 27, 2009 (TW) ..... 98110258 A

(51) Int. Cl.
*B67D 7/78* (2010.01)

(52) U.S. Cl. ..... 222/144; 222/196

(58) Field of Classification Search ..... 222/144, 222/196

See application file for complete search history.

(56) References Cited

U.S. PATENT DOCUMENTS

| | | | | |
|---|---|---|---|---|
| 1,424,682 | A * | 8/1922 | Schlosser | 222/144 |
| 1,438,173 | A * | 12/1922 | Feindt | 222/144.5 |
| 1,551,119 | A * | 8/1925 | Radek | 222/144 |
| 5,626,260 | A * | 5/1997 | Waldner | 222/144 |
| 6,182,839 | B1 * | 2/2001 | Robbins et al. | 211/78 |
| 7,311,223 | B2 * | 12/2007 | Post | 222/1 |
| 8,021,342 | B2 * | 9/2011 | Girgis et al. | 604/187 |
| 8,181,645 | B2 * | 5/2012 | Houzego et al. | 128/203.15 |

* cited by examiner

*Primary Examiner* — Kevin P Shaver
*Assistant Examiner* — Donnell Long
(74) *Attorney, Agent, or Firm* — WPAT PC; Justin King

(57) ABSTRACT

A powder allotting device comprises a supporting device, a coupling device, and a separating device. The supporting device is a base of the powder allotting device, and the supporting device is coupled to the separating device by the coupling device. The a separating device further comprises a rotary plate with a curved grooved structure, a plurality of movable valves, a scraper, and a cylinder with a plurality of T-shape grooves, and a plurality of slices. The plurality of slices are inserted into the T-shape grooves and enter the curved grooved structure, moving up and down the T-shape grooves.

20 Claims, 9 Drawing Sheets

POWDER ALLOTTING DEVICE

FIELD OF THE INVENTION

The present invention relates to a powder allotting device, and more particularly to an automatic powder allotting device.

BACKGROUND OF THE INVENTION

With progress of modern-medicine technology and concept, medical centers now provide Chinese herb with pills, capsules, or medical powders for patients instead of bags of Chinese herbs.

Recent medical powders being used by most medical units are processed powders, wherein these medical powders are placed into convenient pots, thereby medical staffs allot different amounts of medical powders for different patients with various diseases. However, the conventional medical powder allotting device is not very precise for allocating medical powders, because it is still necessary for medical staffs to allocate amounts of medical powders by personal experience and sense.

After the medical powder packing device allocates medical powders, some surplus powders may still remain. Thereafter, these surplus medicines may drop into following medicines for a different disease that could lead to unpredictable results for the next patient. However, the surplus powders only can be cleared or collected by some tools such as a brush or dust cleaner. Additionally, these cleared or collected powders would merely be dumped, and that may cause higher cost and waste issues.

The conventional medical powder allotting devices substantially include an allocating device and a packing device, as disclosed in TW Pat. No. I247604. Referring to FIG. 1, an allocating device includes a rotary plate with a plurality of containers for equally allocating medicines into packages. Besides, the allocating device is still necessary for artificiality to allocate powders into the plurality of containers. Moreover, after allocated powders are into the plurality of containers, the powders fall into packing papers through the bottom of the containers. Finally, the packing papers will be encapsulated by a thermal roll axis.

According to foresaid prior art, the medical powders need to be scraped flat or allocated equally by artificiality. However, the medical powders are allocated or scraped flat and only rely on personnel experience or sense of medical staffs, whereby allocation of the medical powders is not very precise. Hence, the conventional medical powder still lacks a complete technology for equally allocating medical powders.

Moreover, as medical powders are allocated into an allocating device, there may remain some surplus medical powders thereof that may lead to a lot of unpredictable results. For avoiding these unpredictable results, medical staff needs to implement extra clear actions for allocating medical powders. However, it may cause additional medical costs costs that the extra clear actions need extra spending of human resource, cost, and medical powders.

Furthermore, the conventional medical powder allotting device is bulky, therefore it is another issue for reducing volume of the medical powder allotting device.

SUMMARY OF THE INVENTION

According to foresaid background, one purpose of the present invention is to provide a powder allotting device for equally allocating powder.

The present invention provides a powder allotting device, which comprises a supporting device, a coupling device, and a separating device. The supporting device includes a baseplate and an axis, wherein one end of the axis is connected with the baseplate. The coupling device is allocated upon the supporting device and contacting with the other end of the axis. Moreover, the coupling device includes a curved track, a plurality of steel balls, and a funnel, wherein the funnel is allocated on one end of the curved track, the export of the funnel is vertically downward, and the plurality of steel balls is disposed on the curved track. The separating device is allocated upon the coupling device and contacts with the plurality of steel balls, wherein the separating device is a rotatable device.

The separating device, the coupling device, and the supporting device are coaxial. Therefore, when the separating device and the supporting device are rotating, the supporting device vertically overlaps the axial of the separating device.

The separating device comprises a rotary plate, a plurality of valves, a scraper, a cylinder with T-shape rails, and a plurality of slices, wherein the rotary plate includes a curved groove on an upper surface of the rotary plate.

The plurality of valves is formed as a base under the curved groove, wherein the plurality of valves is parallel with each other and contacts with the plurality of steel balls under the plurality of valves, and the plurality of valves is a movable valve. Moreover, the valve directs downward to open when the separating device rotates until one of the pluralities of valves is moving above the funnel.

The scraper is disposed within the curved groove, wherein the scraper is vertical to the plurality of valves, and the scraper can slide back and forth along the curved groove. Furthermore, the scraper is mobile and the scraper can move up and down in vertical direction, and the scraper can be fastened above the curved groove by a plug when the scraper moves up.

The cylinder with T-shape rails is allocated upon the rotary plate, wherein the cylinder with T-shape rails includes a plurality of T-shape rails on lateral side of the cylinder with T-shape rails.

The plurality of slices is disposed into the T-shape rails, wherein the plurality of slices can move up and down along the T-shape rails, besides the plurality of slices is vertical to and contacts with the plurality of valves as the plurality of slices are moving down. Moreover, the plurality of slices comprises a lower slice, when the plurality of slices moves down and contacts with the plurality of valves, the lower slice contacts with the plurality of valves and an interval between each of the plurality of valves. Additionally, the lower slice can be formed as stainless steel.

The powder allotting device of the present invention comprises a linking-up ring being allocated upon the cylinder with T-shape rails, and the linking-up ring includes a plurality of bolts, wherein the plurality of slices engages with said plurality of bolts. Furthermore, the plurality of bolts moves downward and promotes the plurality of slices downward movement when the linking-up ring moves downward, whereby movement of the plurality of slices can be synchronously controlled.

The powder allotting device of the present invention comprises a vibration motor electronically connecting with the rotary plate, wherein the vibration motor is used for vibrating the rotary plate.

One purpose of the present invention is to provide an automatic powder allotting device for equally allocating powder and promoting the efficiency of powder allotting device. For achieving the purpose, the powder allotting device of present invention comprises a stepping motor being allocated inside the cylinder with T-shape rails, wherein the stepping motor is used for rotating the separating device.

The present invention also provide a powder separating device, which comprises a rotary plate, a plurality of valves, a scraper, a cylinder with T-shape rails, and a plurality of slices, wherein the rotary plate includes a curved groove on an upper surface of the rotary plate. Moreover, the plurality of valves is formed as a base under the curved groove, wherein the plurality of valves is parallel with each other.

The scraper is disposed within the curved groove, wherein the scraper is vertical to the plurality of valves, and the scraper can slide back and forth along the curved groove. Furthermore, the scraper is mobile and the scraper can move up and down in vertical direction, and the scraper can be fastened above the curved groove by a plug when the scraper moves up.

The cylinder with T-shape rails is allocated upon the rotary plate, wherein the cylinder with T-shape rails includes a plurality of T-shape rails on lateral side of the cylinder with T-shape rails.

The plurality of slices is disposed into the T-shape rails, wherein the plurality of slices can move up and down along the T-shape rails, besides the plurality of slices is vertical to and contacts with the plurality of valves as the plurality of slices moving down. Moreover, the plurality of slices comprises a lower slice. When the plurality of slices moves down and contacts with the plurality of valves, the lower slice contacts with the plurality of valves and an interval between each of the plurality of valves. Additionally, the lower slice can be formed as stainless steel.

The powder separating device of the present invention comprises a linking-up ring being allocated upon the cylinder with T-shape rails, the linking-up ring includes a plurality of bolts, wherein the plurality of slices engages with said plurality of bolts. Furthermore, the plurality of bolts moves downward and promotes the plurality of slices downward movement when the linking-up ring moves downward, whereby movement of the plurality of slices can be synchronously controlled.

The powder separating device of the present invention comprises a vibration motor electronically connecting with the rotary plate, wherein the vibration motor is used for vibrating the rotary plate and reducing remain of powders.

The automatic powder allotting device can automatically and equally allocate amount of powders for solving unequally allocating powder issue.

BRIEF DESCRIPTION OF THE DRAWINGS

FIG. 5(*b*) is a perspective stereogram of the rotary plate of the present invention;

FIG. 5(*c*) is a perspective stereogram of the valve of the present invention;

FIG. 5(*d*) is a perspective stereogram of the scraper of the present invention;

FIG. 5(*e*) is a perspective stereogram of the cylinder with T-shape rails of the present invention;

FIG. 5(*f*) is a perspective stereogram of the slice of the present invention;

FIG. 5(*g*) is a perspective stereogram of the linking-up ring of the present invention;

DESCRIPTION OF THE EXEMPLARY EMBODIMENTS

Figure 1:
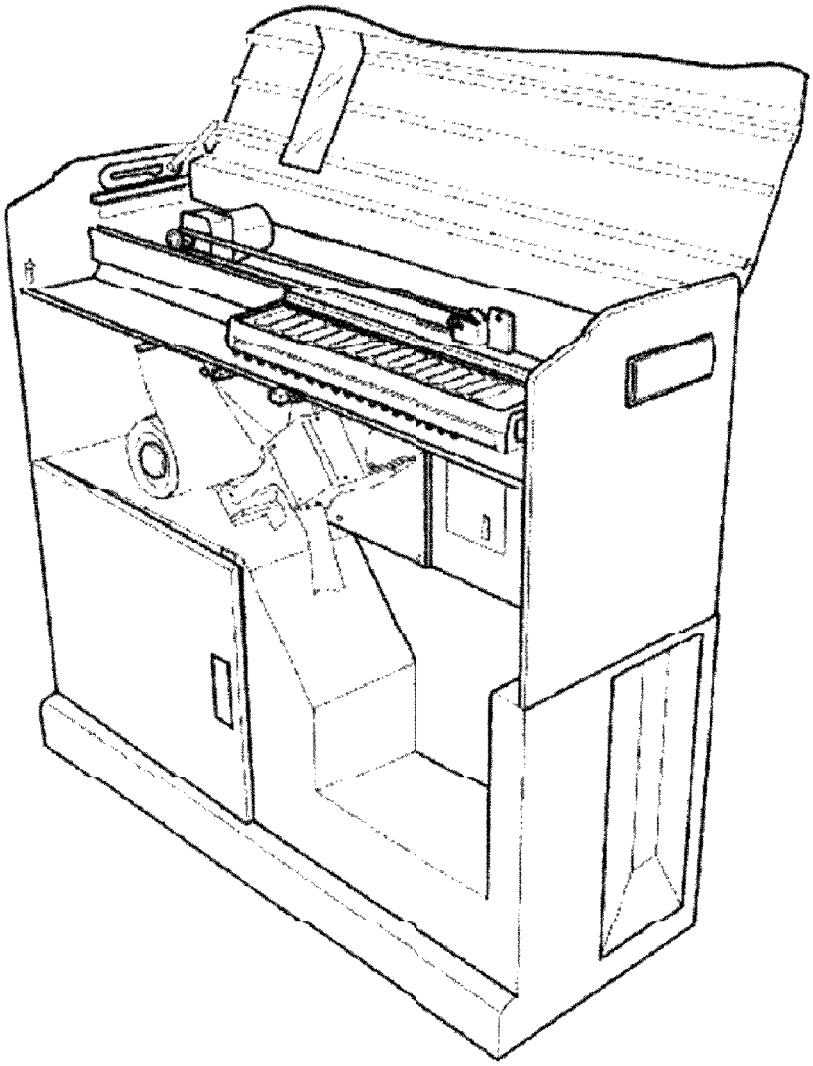
FIG. 1 (PRIOR ART)
FIG. 1 is a stereogram of a prior powder allocating device.

One aspect of the present invention is to discuss an automatic powder allocating device. To thoughtfully understand the present invention for the readers, the procedures and the components will be described in detail below. Obviously, practice of the present invention is not intended to place restrictions on the automatic powder allocating device that those of ordinary skill in the art can understand the partial detail. On the other hand, the procedures or the components which are known to all are not specified in this application, to avoid causing limitation on the present invention. The best model of the present invention will be specified below, however, except those detailed descriptions, the present invention also can be used widely within other embodiments, otherwise the scope of the present invention does will not be restricted, and it will be principle to below claims.

The present invention provides a powder allotting device, which comprises a supporting device, a coupling device, and a separating device. The supporting device includes a baseplate and an axis, wherein one end of the axis is connected with the baseplate.

The coupling device is allocated upon the supporting device and contacts with the other end of the axis. Moreover, the coupling device includes a curved track, a plurality of steel balls, and a funnel, wherein the funnel is allocated on one end of the curved track, the export of the funnel is vertically downward, and the plurality of steel balls is disposed on the curved track.

The separating device is allocated upon the coupling device and contacts with the plurality of steel balls, wherein the separating device is a rotatable device.

The separating device, the coupling device, and the supporting device are coaxial. Therefore, when the separating device and the supporting device are rotating, the supporting device vertically overlaps the axial of the separating device.

The separating device comprises a rotary plate, a plurality of valves, a scraper, a cylinder with T-shape rails, and a plurality of slices, wherein the rotary plate includes a curved groove on an upper surface of the rotary plate.

The plurality of valves is formed as a base under the curved groove, wherein the plurality of valves is parallel with each other and contacts with the plurality of steel balls under the plurality of valves, and the plurality of valves is a movable valve. Moreover, the valve directs downward to open when the separating device rotates until one of the plurality of valves is moving above the funnel.

The scraper is disposed within the curved groove, wherein the scraper is vertical to the plurality of valves, and the scraper can slide back and forth along the curved groove. Furthermore, the scraper is mobile and can move up and down in a vertical direction, and the scraper can be fastened above the curved groove by a plug when the scraper moves up.

The cylinder with T-shape rails is allocated upon the rotary plate, wherein the cylinder with T-shape rails includes a plurality of T-shape rails on the lateral side of the cylinder with T-shape rails.

The plurality of slices is disposed into the T-shape rails, wherein the plurality of slices can move up and down along the T-shape rails, besides the plurality of slices is vertical to and contacts with the plurality of valves as the plurality of slices move down. Moreover, the plurality of slices comprises a lower slice, when the plurality of slices moves down and contacts with the plurality of valves, the lower slice contacts with the plurality of valves and an interval between each of the plurality of valves. Additionally, the lower slice can be formed as stainless steel.

The powder allotting device of the present invention comprises a linking-up ring being allocated upon the cylinder with T-shape rails, and the linking-up ring includes a plurality of bolts, wherein the plurality of slices engages with said plurality of bolts. Furthermore, the plurality of bolts moves downward and promotes the plurality of slices downward movement when the linking-up ring moves downward, whereby movement of the plurality of slices can be synchronously controlled.

The powder allotting device of the present invention comprises a vibration motor electronically connecting with the rotary plate, wherein the vibration motor is used for vibrating the rotary plate.

One purpose of the present invention is to provide an automatic powder allotting device for equally allocating powder and promoting the efficiency of the powder allotting device. For achieving the purpose, the powder allotting device of the present invention comprises a stepping motor being allocated inside the cylinder with T-shape rails, wherein the stepping motor is used for rotating the separating device.

The present invention also provides a powder separating device, which comprises a rotary plate, a plurality of valves, a scraper, a cylinder with T-shape rails, and a plurality of slices, wherein the rotary plate includes a curved groove on an upper surface of the rotary plate. Moreover, the plurality of valves is formed as a base under the curved groove, wherein the plurality of valves is parallel with each other.

The scraper is disposed within the curved groove, wherein the scraper is vertical to the plurality of valves, and the scraper can slide back and forth along the curved groove. Furthermore, the scraper is mobile and the scraper can move up and down in vertical direction, and the scraper can be fastened above the curved groove by a plug when the scraper moves up.

The cylinder with T-shape rails is allocated upon the rotary plate, wherein the cylinder with T-shape rails includes a plurality of T-shape rails on the lateral side of the cylinder with T-shape rails.

The plurality of slices is disposed into the T-shape rails, wherein the plurality of slices can move up and down along the T-shape rails, besides the plurality of slices is vertical to and contacts with the plurality of valves as the plurality of slices moving down. Moreover, the plurality of slices comprises a lower slice. When the plurality of slices moves down and contacts with the plurality of valves, the lower slice contacts with the plurality of valves and an interval between each of the plurality of valves. Additionally, the lower slice can be formed as stainless steel.

The powder separating device of the present invention comprises a linking-up ring being allocated upon the cylinder with T-shape rails; the linking-up ring includes a plurality of bolts, wherein the plurality of slices engages with said plurality of bolts. Furthermore, the plurality of bolts moves downward and promotes the plurality of slices downward movement when the linking-up ring moves downward, whereby movement of the plurality of slices can be synchronously controlled.

The powder separating device of the present invention comprises a vibration motor electronically connecting with the rotary plate, wherein the vibration motor is used for vibrating the rotary plate and reducing remain of powders.

The automatic powder allotting device can automatically and equally allocate amounts of powders for solving unequally allocating powder issues.

Exemplary embodiments of the present invention will now be described with reference to the accompanying drawings.

Figure 2:
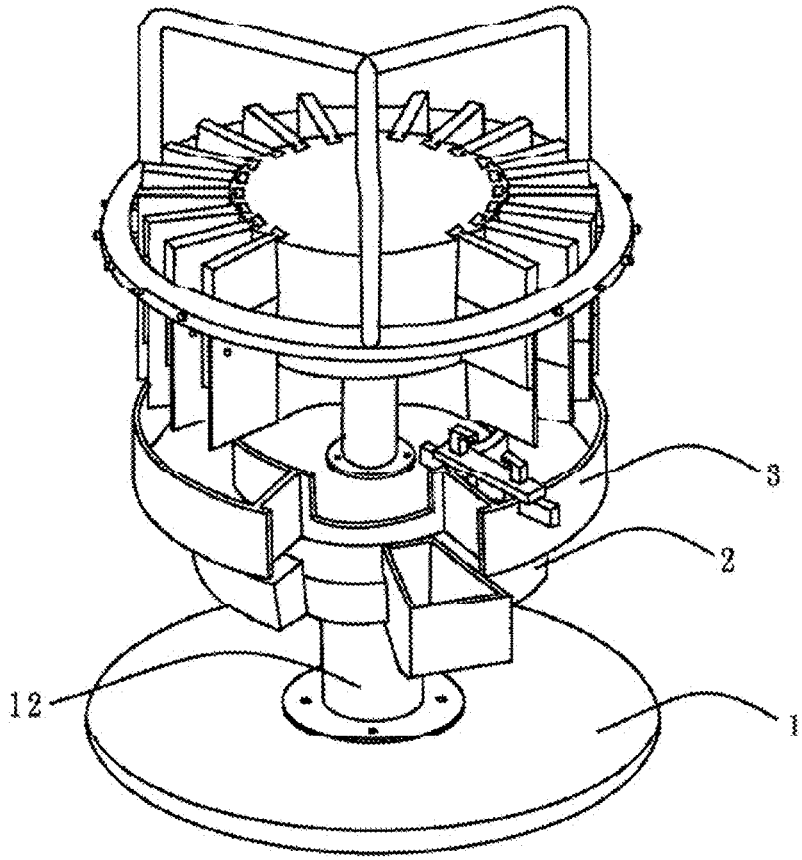
FIG. 2 is a stereogram of the powder allocating device of the present invention.

As shown in FIG. 2, the present invention provides a powder allotting device, which comprises a supporting device 1, a coupling device 2, and a separating device 3, wherein the supporting device 1 is a base of the powder allotting device, and the supporting device 1 contacts with the separating device 3 by the coupling device 2. The separating device 3, the coupling device 2, and the supporting device 1 are coaxial. Therefore when the separating device 3 and the supporting device 1 are rotating, the supporting device 3 vertically overlaps the axial of the separating device 3.

Figure 3:
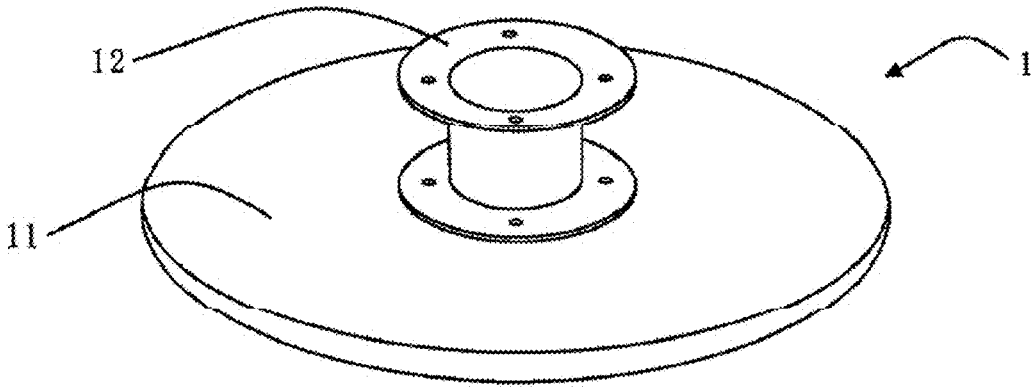
FIG. 3 is a stereogram of the supporting device of the present invention.

A primary function of the supporting device 1 is to support the coupling device 2 and the separating device 3 above the supporting device 1. As shown in FIG. 3, the supporting device 1 includes a baseplate 11 and an axis 12, wherein one end of the axis 12 contacts with the baseplate 11.

In an embodiment of the present invention, the baseplate 11 is a circular structure and the axis 12 is a bearing. Besides, the axis 12 is allocated on the middle of the baseplate 11 so as to enhance the stability of the powder allotting device. Additionally, the axis 12 can be made as a hollow metal structure, and two ends of the axis 12 can individually be fastened on up portion and lower portion of other coupling institutions by screws. Moreover, the baseplate 11 is composed of the materials such as metal or rigid woods.

Figure 4:
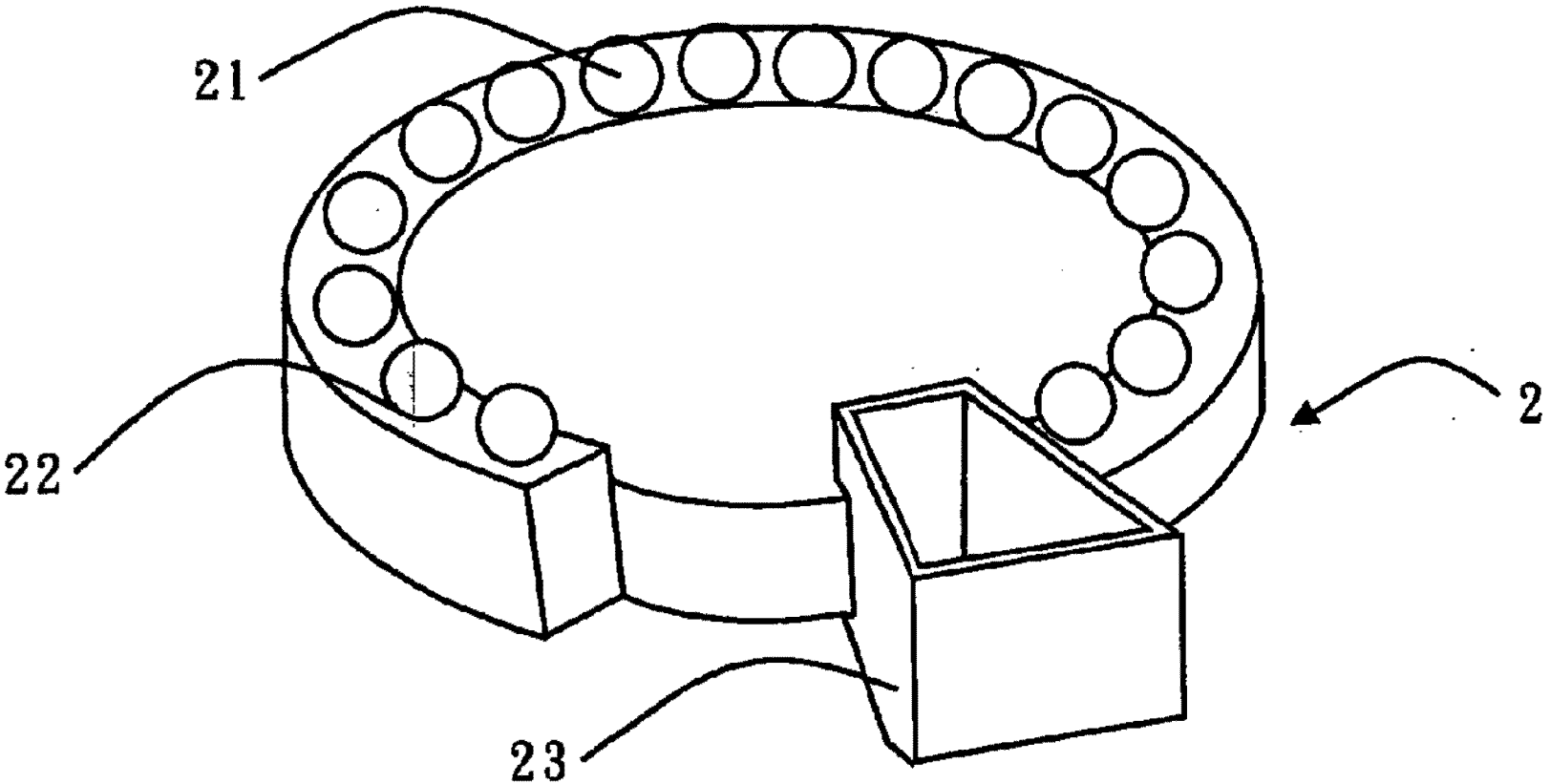
FIG. 4 is a stereogram of the coupling device of the present invention.
Figure 5A:
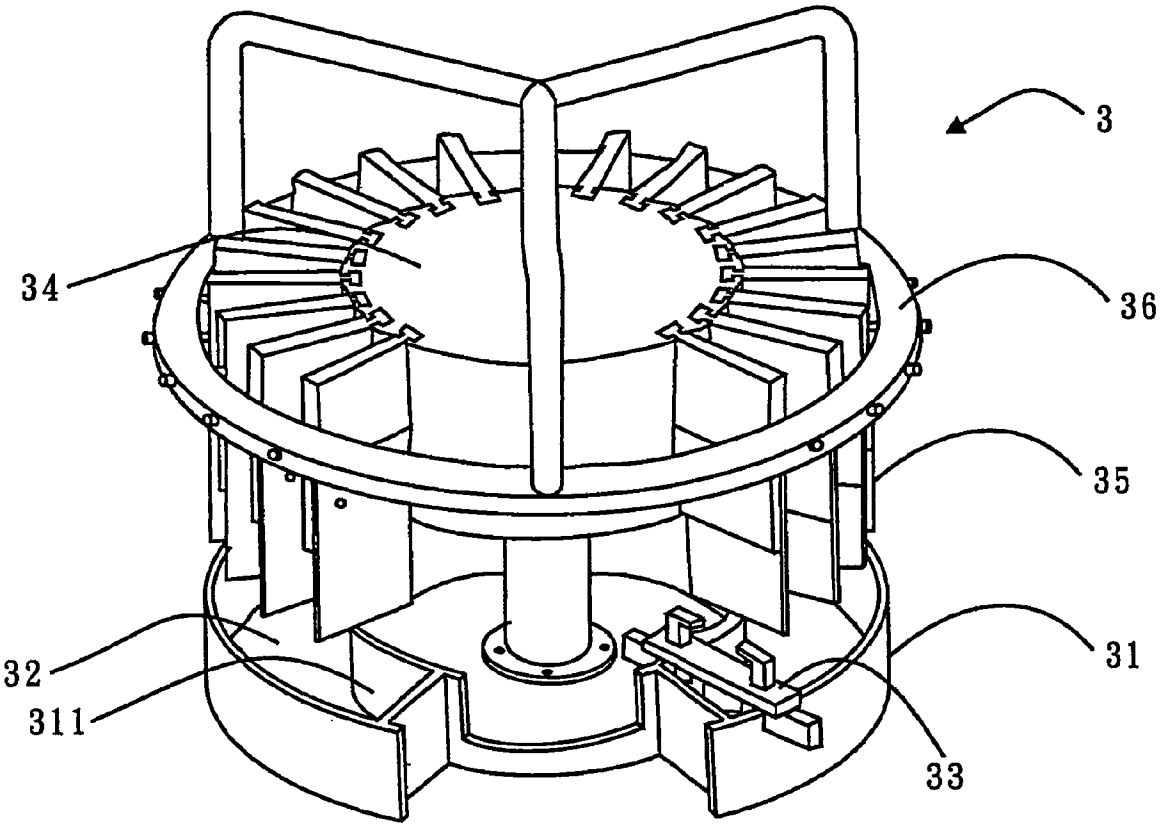
FIG. 5(*a*) is a stereogram of the separating device of the present invention.
Figure 5B:
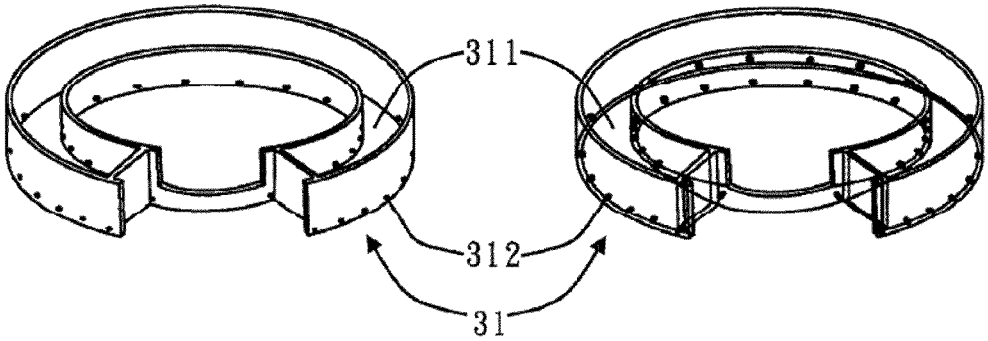
Figure 5C:
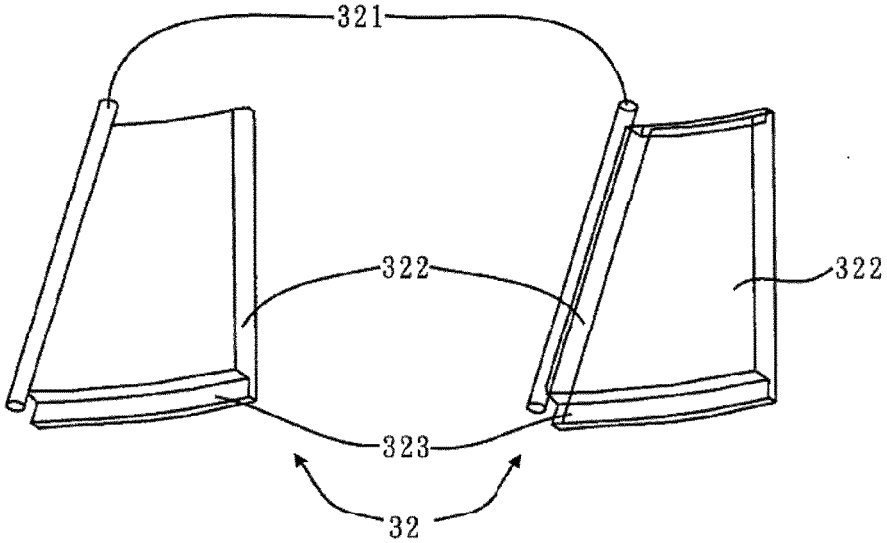
Figure 5D:
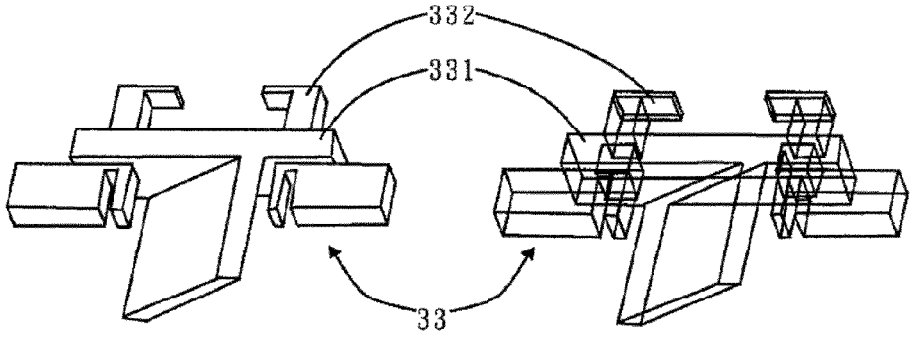
Figure 5E:
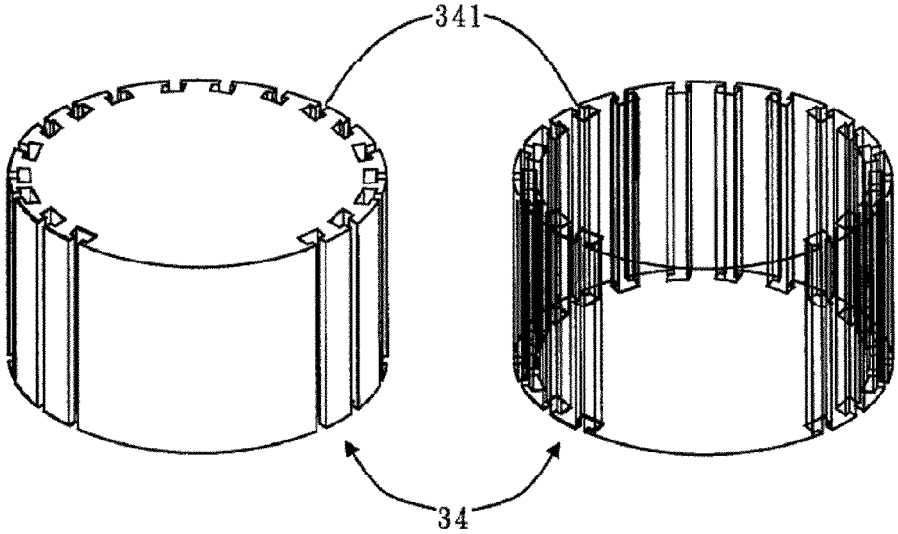
Figure 5F:
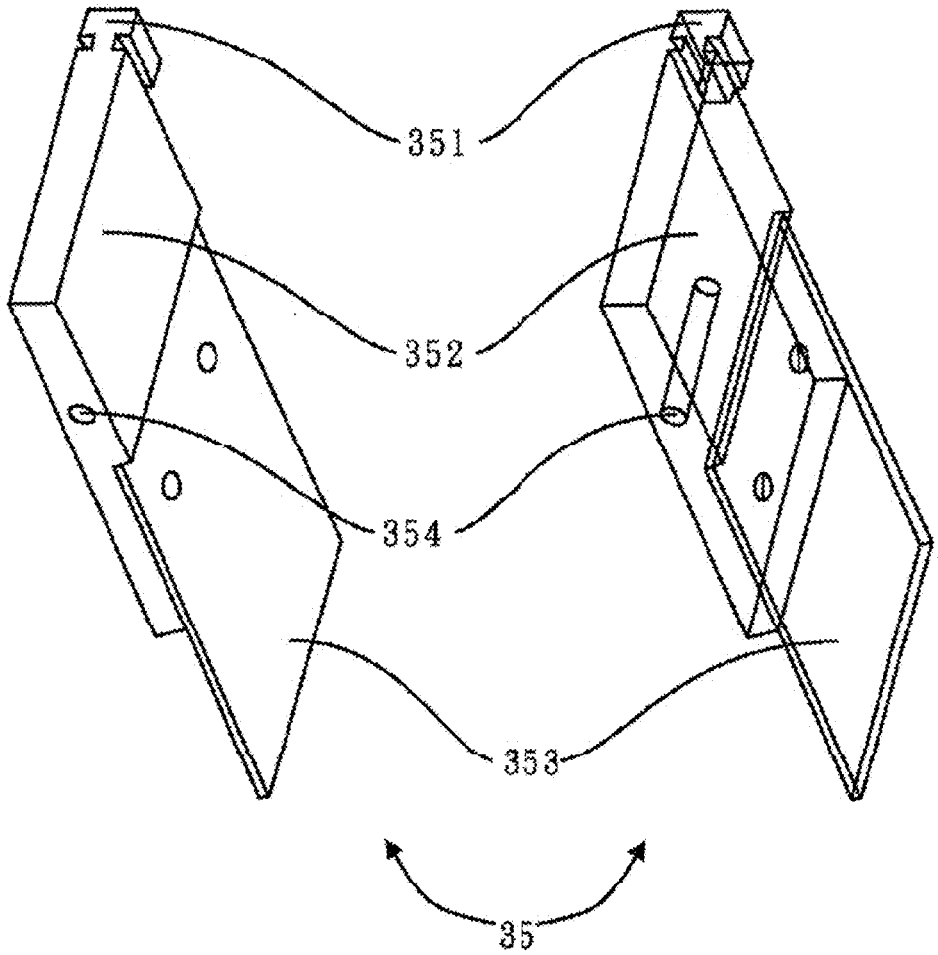
Figure 5G:
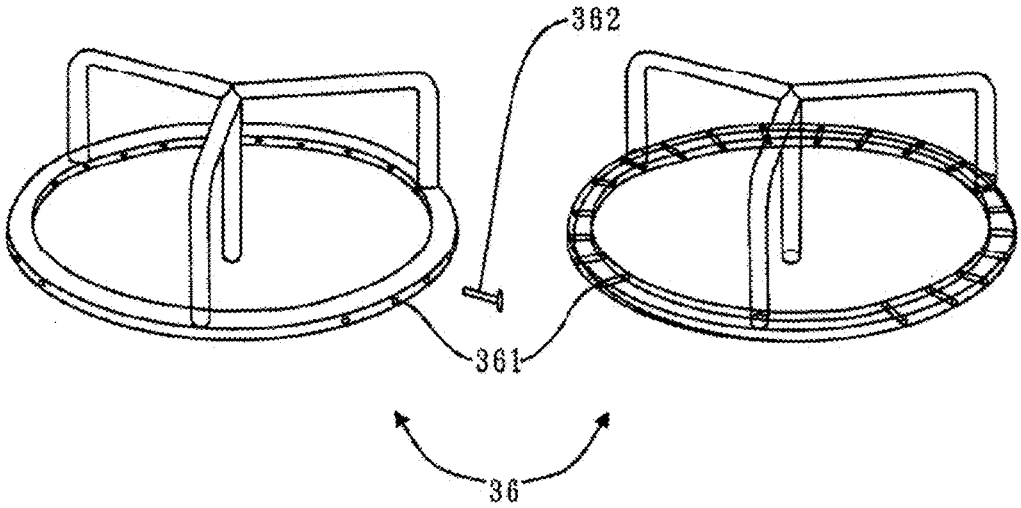

The coupling device 2 is allocated upon the supporting device 1 and contacts with the other end of the axis 12. The primary function of the coupling device 2 is to couple with the separating device 3 so as to provide a rotary plane for the separating device 3. As shown in FIG. 4, the coupling device 2 includes a curved track 22, a plurality of steel balls 21, and a funnel 23, wherein the funnel 23 is allocated on one end of the curved track 22, the export of the funnel 23 is vertically downward, and the plurality of steel balls 21 is disposed on the curved track 22.

In an embodiment of the present invention, the plurality of steel balls 21 is adopted for a globe with a diameter of 12 mm. Moreover, the coupling device 2 contacts with the separating device 3 by the plurality of steel balls 21, wherein surface contact between the coupling device 2 and the separating device 3 becomes the point of contact, and the plurality of steel balls 21 is such as a ball bearing. By utilizing rotary features of the plurality of steel balls 21, the powder allotting device can work smoothly because of lower friction between the coupling device 2 and the separating device 3. Furthermore, the width of the curved track 22 is smaller than the diameter of the plurality of steel balls 21 so as to support the plurality of steel balls 21 upon the curved track 22 and the plurality of steel balls 21 exposes a portion of the curved track 22. Besides for reducing weight of the powder allocating device, the curved track 22 can be acrylic such as Polymethylmethacrylate (PMMA).

In an embodiment of the present invention, the funnel 23 is used for guiding powders falling into a packing device along the export of the funnel 23 by gravity. Additionally, the funnel 23 can be made by aluminum films, wherein this metal material can reduce electrostatic occurrence for avoiding the residual powders issue.

The separating device 3 is allocated upon the coupling device 2 and contacts with the plurality of steel balls 21. As shown in FIG. 5(*a*), the separating device 3 includes a rotary plate 31, a plurality of valves 32, a scraper 33, a cylinder with T-shape rails 34, and a plurality of slices 35.

The rotary plate 31 includes a curved groove 311 allocated on an upper surface of the rotary plate 31, wherein the curved groove 311 is used for loading above powders. Moreover, the plurality of valves 32 is formed as a base under the curved groove 311, wherein the plurality of valves 32 is parallel with each other, and the plurality of valves 32 is a movable valve. Furthermore, the scraper 33 is disposed within the curved groove 311, wherein the scraper 33 is vertical to the plurality of valves 32. Moreover, the scraper 33 is across upon the curved groove 311 whereby the scraper 33 can slide back and forth along the curved groove 311. As sliding the scraper 33 back and forth along the curved groove 311, the powders inside the rotary plate 31 can be mixed uniformly. Further, the cylinder with T-shape rails 34 is allocated upon the rotary plate 31, wherein the cylinder with T-shape rails 34 includes a plurality of T-shape rails (not shown in drawing) on lateral side of the cylinder with T-shape rails 34. In addition, the plurality of slices 35 is disposed into the T-shape rails, wherein the plurality of slices 35 can move up and down along the T-shape rails.

In one embodiment of the present invention, the powder allocating device comprises a linking-up ring 36 being allocated upon the cylinder with T-shape rails 34. When the linking-up ring 36 moves downward and promotes the plurality of slices 35 downward, whereby movement of the plurality of slices 35 and the linking-up ring 36 can be synchronously controlled.

As shown in FIG. 5(*b*), for allocating the plurality of valves 32 under the curved groove 311 and forming a base thereof, a plurality of notches 312 can be allocated on a lateral side of the curved groove 311 for supporting the rotary axis of the plurality of valves 32. Besides, the rotary plate 31 is used for loading above powders, wherein the rotary plate 31 can be made by materials of acrylic or Polymethylmethacrylate (PMMA).

As shown in FIG. 5(*c*), in one embodiment of the present invention, wherein the plurality of valves 32 is a sector with an angle of 15°, and the plurality of valves 32 includes a rotary axis 321. When the support under the plurality of valves 32 is moved, the plurality of valves 32 can direct downward to open by rotating the rotary axis 321 suspending in the plurality of notches 312. Besides, each interval of the plurality of valves 32 is an oblique junction 322, and a vertical junction 323 is disposed between the plurality of valves 32 and the curved groove 311. By the foregoing structure, when the support under the plurality of valves 32 is moved, the plurality of valves 32 will not be supported with each other; on the other hand, each of the plurality of valves 32 will be supported by each other when the plurality of valves 32 is closed. Moreover, the interval between the pluralities of valves 32 will be narrowed with the foregoing structure for reducing the residual powders issue. Additionally, in one embodiment of the present invention, the plurality of valves 32 is acrylic, Polymethylmethacrylate (PMMA), or any rigid metal.

As shown in FIG. 5(*d*), one embodiment of the present invention, the scraper 33 is mobile so that the scraper 33 not only can slide back and forth along the curved groove 311, but also move up and down in a vertical direction. On the other hand, the scraper 33 also can be arisen and fastened, when an upper scraper 331 of the scraper 33 is fixed by a bulge 332, whereby the scraper 33 is fastened and moved away from the surface of the powders. Additionally, in one embodiment of the present invention, wherein the scraper 33 is acrylic, Polymethylmethacrylate (PMMA), or any rigid metal.

As shown in FIG. 5(*e*), the cylinder with T-shape rails 34 is allocated on the rotary plate 31, wherein the cylinder with T-shape rails 34 includes a plurality of T-shape rails 341 on lateral side of the cylinder with T-shape rails 34. In one embodiment of the present invention, the cylinder with T-shape rails 34 is Polyvinylchloride (PVC) and can be formed by a milling cutter.

The plurality of slices 35 is disposed into the plurality of T-shape rails 341, wherein the plurality of slices 35 can be moved up and down along the T-shape rails 341. In one embodiment of the present invention, as shown in FIG. 5(*f*), each of the slices 35 includes a slide block 351 according to the T-shape rails 341 for moving the plurality of slices 35 up and down along the T-shape rails 341. Besides, the plurality of slices 35 includes an upper slice 352 and a lower slice 353, wherein the lower slice 353 is fastened on the upper slice 352 by screws. Moreover, the upper slice 352 comprises a circular hole 354 for coupling the linking-up ring 36 (not shown in drawing).

In one embodiment of the present invention, the upper slice 352 is plastic such as polyvinyl chloride (PVC). And the lower slice 353 is stainless steel, whereby the lower slice 353 is rigid and less weight. Besides, stainless steel of the lower slice 353 can avoid electrostatic and have a powders coating over the surface of the slices 35.

In one embodiment of the present invention, as shown in FIG. 5(*g*), the powder allocating device comprises a linking-up ring 36. The linking-up ring 36 includes a plurality of jacks 361 and a plurality of bolts 362, wherein the plurality of bolts 362 can engage with the plurality of jacks 361 for attaching to the plurality of slices 35 (not shown in drawing). Therefore, the linking-up ring 36 moves downward and promotes the plurality of slices 35 downward movement simultaneously, whereby movement of the plurality of slices 35 can be controlled synchronously with the linking-up ring 36. Additionally, in one embodiment of the present invention, the linking-up ring 36 and the plurality of bolts 362 both are acrylic, Polymethylmethacrylate (PMMA), or any rigid metal.

For allocating different portions of powders, it is alternating the plurality of slices also can be moved independently but not with the linking-up ring. For instance, a controller wants the powder allocating device allocating fifteen portions of powders; first, individually move downward the first and the fifteenth slices of the powder allocating device; second, put powders into the interval between the first and the fifteenth slices; third, scrape smooth the powders; fourth, simultaneously move downward the second to fourteenth slices by the linking-up ring, whereby fifteen portions of powders are equally allocated.

The separating device of the present invention is allocated upon the coupling device and contacts with the plurality of steel balls, wherein the plurality of valves of the separating device contacts with upper portion of the plurality of steel balls, and the plurality of valves is close because of the supporting from the plurality of steel balls. When the separating device starts to rotate until one of the valves is moved above the funnel, wherein the valve above the funnel is opened due to supporting loss. As the separating device is proceeding to rotate, the opening valve will be closed by the support from the steel balls, whereby the plurality of valves will be opened and closed step by step.

The present invention provides a packing device contacting with the funnel. After powders are allocated, portions of the powders will be transferred into the packing device via the funnel one by one.

One purpose of the present invention is to provide an automatic powder allocating device for enhancing the efficiency of a powder allocating device. Hence, one embodiment of the present invention comprises a stepper motor allocated inside the cylinder with T-shape rails for automatically rotating the separating device. After the powders are allocated, the rotary plate can be rotated once in an angle by the stepper motor. When each of the rotary plates is rotated in an angle, one of the valves is departed from the plurality of steel balls and contacting with the funnel to open. Moreover, one embodiment of the present invention provides a vibration motor contacting with the rotary plate, whereby the rotary plate can be vibrated by the vibration motor for avoiding the residual powders issue.

Figure 6:
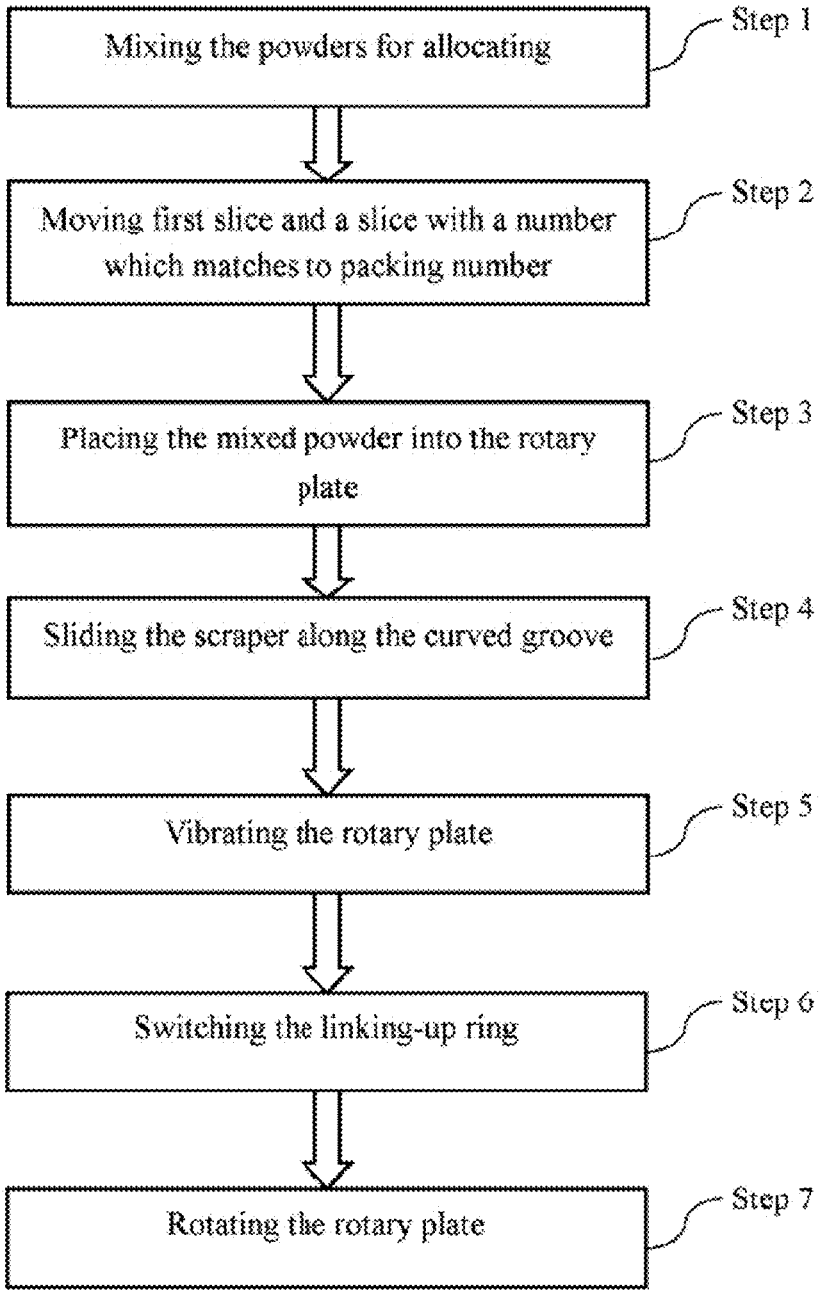
FIG. 6 is a flow diagram showing the steps for operating the powder allocating device of the present invention.

As shown in FIG. 6, the present invention provides an operational process for the powder allocating device of the present invention, as following describing:

Step 1. Mixing the powders for allocating;

Step 2. Moving first slice and a slice with a number which matches to the packing number (for example, as the packing number is fifteen, then move downward the fifteenth slice independently);

Step 3. Placing the mixed powder into the rotary plate;

Step 4. Sliding the scraper along the curved groove for uniformly scraping the loose powders;

Step 5. Vibrating the rotary plate for shaking the above powder into lower position that fills up the holes inside the powder and makes uniform the loose powders;

Step 6. Switching the linking-up ring for moving the other valves downward and allocating the uniform and filled powder (the powder will be allocated into fifteen portions);

Step 7. Rotating the rotary plate, when one of the valves is departed from the plurality of steel balls and contacting with the funnel to open. Each portion of the powder will be fallen into the packing device and be packaged.

Figure 7:
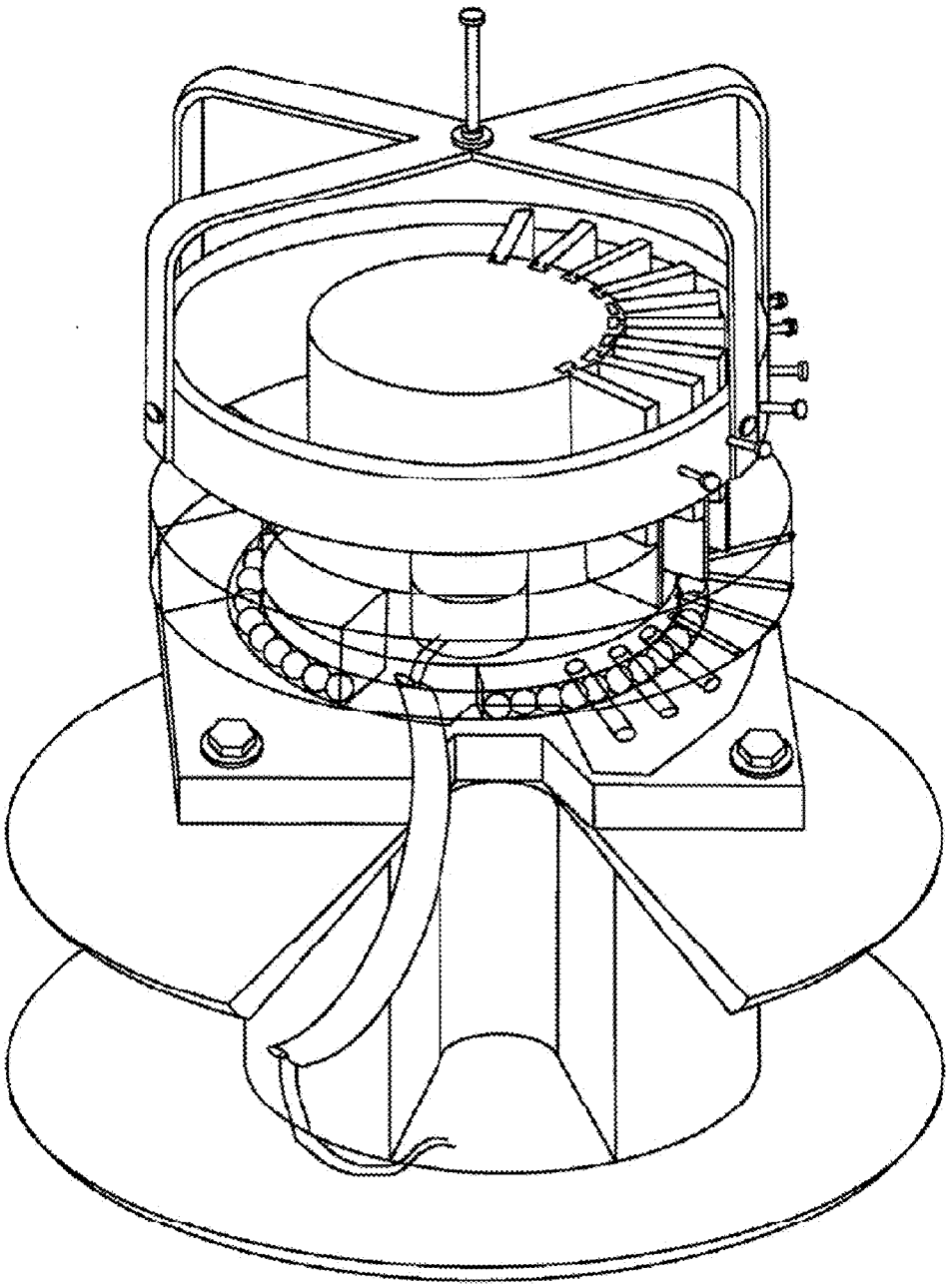
FIG. 7 is a real picture of the powder allocating device of the present invention.

As shown in FIG. 7, the present invention provides the powder allocating device which has a smaller volume than prior arts for reducing extra engaged space. Moreover, powder allocating device of the present invention can automatically and uniformly allocate powder for avoiding allocating uneven powders.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A powder apportioning device, comprising:

a supporting device including a baseplate and a axis;

a coupling device positioned on said axis, including a curved track, a plurality of steel balls, and a funnel, wherein said funnel is placed at an end of said curved track, and said plurality of steel balls is placed on said curved track; and a separating device positioned on said plurality of steel balls, comprising:

a rotary plate including a curved grooved structure;

a plurality of movable valves, positioned within said curved grooved structure, wherein said plurality of movable valves is parallel with each other and adjacent to said plurality of steel balls;

a scraper, positioned on said curved grooved structure, for sliding back and forth along said curved grooved structure;

a cylinder positioned on said rotary plate, including a plurality of T-shape grooves; and a plurality of slices, inserted into said T-shape grooves, wherein said plurality of slices move along said T-shape grooves to enter into said curved grooved structure and to contact with said plurality of movable valves.

2. The powder apportioning device as in claim 1, wherein said separating device, said coupling device, and said supporting device are coaxial.

3. The powder apportioning device as in claim 2, of said plurality of slices further comprises a lower portion, and said lower portion touches said plurality of movable valves when said plurality of slices moves down along said T-shape grooves.

4. The powder apportioning device as in claim 3, wherein said lower portion is stainless steel.

5. The powder apportioning device as in claim 2, a first movable valve of said plurality of movable valves is positioned above said funnel and is opened when said separating device rotates and moves said first movable valve above said funnel.

6. The powder apportioning device as in claim 2, each of said plurality of slices contact with only one of said plurality of movable valves when said plurality of slices is contacting said plurality of valves.

7. The powder apportioning device as in claim 2, wherein said scraper is inserted into said curved grooved structure vertically and moves within said curved grooved structure.

8. The powder apportioning device as in claim 7, wherein said scraper can be fastened above said curved groove by a plug.

9. The powder apportioning device as in claim 2, further comprises a linking-up ring, positioning above said cylinder, including a plurality of bolts, wherein said plurality of slices engages with said plurality of bolts.

10. The powder apportioning device as in claim 9, said linking-up ring moves said plurality of slices synchronously.

11. The powder apportioning device as in claim 2, further comprises a stepping motor, positioned within said cylinder, for turing said separating device.

12. The powder apportioning device as in claim 2, further comprises a vibration motor, electronically connecting with said rotary plate, for vibrating said rotary plate.

13. A powder separating device, comprising:

a rotary plate including a curved grooved structure;

a plurality of movable valves, positioned within said curved grooved structure, wherein each of said plurality of movable valves is parallel to each other;

a scraper, positioned on said curved grooved structure, for sliding back and forth along said curved grooved structure;

a cylinder, positioned on said rotary plate, including a plurality of T-shape grooves; and a plurality of slices, inserted into said T-shape grooves, wherein said plurality of slices move up and down along said T-shape grooves to enter into said curved grooved structure and to contact with said plurality of movable valves.

14. The powder separating device as in claim 13, said plurality of slices further comprises a lower portion, and said lower portion touches said plurality of movable valves when said plurality of slices moves down along said T-shape grooves.

15. The powder separating device as in claim 14, wherein said lower portion is stainless steel.

16. The powder separating device as in claim 13, wherein said scraper is inserted into said curved grooved structure vertically and moves within said curved grooved structure.

17. The powder separating device as in claim 16, wherein said scraper can be fastened above said curved groove by a plug.

18. The powder separating device as in claim 13, further comprises a linking-up ring, positioning above said cylinder, including a plurality of bolts, wherein said plurality of slices engages with said plurality of bolts.

19. The powder separating device as in claim 18, said linking-up ring moves said plurality of slices synchronously.

20. The powder separating device as in claim 13, further comprises a vibration motor, electronically connecting with said rotary plate, for vibrating said rotary plate.

* * * * *